US005247721A

United States Patent [19]

Demuth et al.

[11] Patent Number: 5,247,721

[45] Date of Patent: Sep. 28, 1993

[54] GRID FOR THE OPENING ROLL OF A SPINNING MACHINE

[75] Inventors: Robert Demuth, Nurensdorf; Jurg Faas, Dinhard; Lukas Hiltbrunner, Reutlingen, all of Switzerland

[73] Assignee: Maschinenfabrik Rieter AG, Winterthur, Switzerland

[21] Appl. No.: 775,530

[22] Filed: Oct. 15, 1991

[30] Foreign Application Priority Data

Oct. 16, 1990 [CH] Switzerland ..... 03 318/90

[51] Int. Cl.[5] ..... D01G 15/40; D01G 15/76

[52] U.S. Cl. ..... 19/105; 19/107; 19/200

[58] Field of Search ..... 19/97.5, 98, 105, 107, 19/200, 205

[56] References Cited

U.S. PATENT DOCUMENTS

| | | | |
|---|---|---|---|
| 2,952,881 | 9/1960 | Moss et al. . | |
| 3,854,170 | 12/1974 | Caughlin . | |
| 4,505,005 | 3/1985 | Staehli | 19/200 |
| 4,507,827 | 4/1985 | Staehli | 19/200 |
| 4,547,935 | 10/1985 | Jagst | 19/200 X |
| 4,686,744 | 8/1987 | Shofner | 19/105 X |
| 4,797,978 | 1/1989 | Giuliani | 19/107 X |
| 4,969,235 | 11/1990 | Marx | 19/105 |
| 5,031,278 | 7/1991 | Demuth et al. | 19/107 X |
| 5,107,571 | 4/1992 | Marzoli et al. | 19/105 |
| 5,107,572 | 4/1992 | Schmid et al. | 19/200 |

FOREIGN PATENT DOCUMENTS

| | | | |
|---|---|---|---|
| 0250126 | 12/1987 | European Pat. Off. | 19/98 |
| 0275471 | 7/1988 | European Pat. Off. . | |
| 0388791 | 9/1990 | European Pat. Off. . | |
| 0419415 | 3/1991 | European Pat. Off. . | |
| 203532 | 10/1908 | Fed. Rep. of Germany . | |
| 3333618 | 4/1985 | Fed. Rep. of Germany . | |
| 3720037 | 12/1987 | Fed. Rep. of Germany . | |
| 3734313 | 4/1989 | Fed. Rep. of Germany | 19/98 |
| 464021 | 11/1968 | Switzerland . | |
| 669401 | 3/1989 | Switzerland . | |
| 2000820 | 1/1979 | United Kingdom . | |
| 2053995 | 2/1981 | United Kingdom . | |
| 2210907 | 6/1989 | United Kingdom . | |

*Primary Examiner*—Clifford D. Crowder
*Assistant Examiner*—John J. Calvert
*Attorney, Agent, or Firm*—Sandler, Greenblum & Bernstein

[57] ABSTRACT

In order to better accommodate the cleaning functions of a cleaning machine or those of a licker-in roll of a card to the different and increased requirements placed upon the cleaning action, a grid is provided for a cleaning machine. This grid is displaceable in at least one direction and grid bar modules or grid modules are provided in a predetermined sequence at the grid such that there can be appropriately influenced the cleaning results. The grid bar modules or grid modules are either fixedly mounted by, for instance, a screw or threaded bolt or are pivotable by means of an adjustment motor about the pivot axis of a pivotable shaft.

31 Claims, 6 Drawing Sheets

CONTROL

FIG. 2
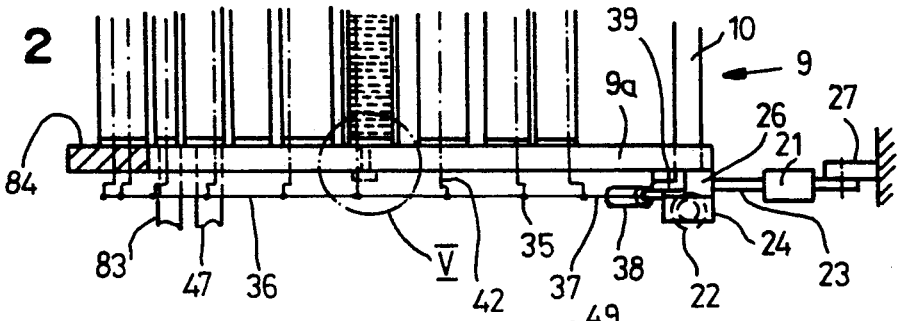
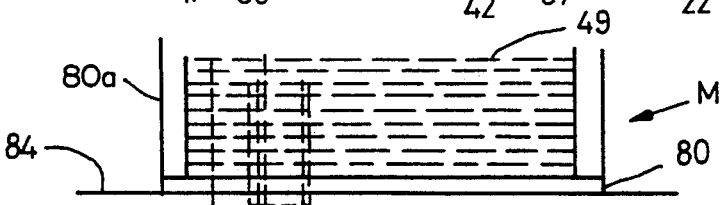
FIG. 3
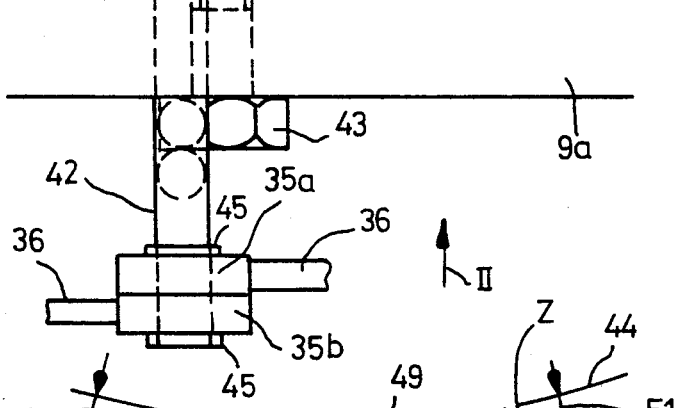
FIG. 13
FIG. 4
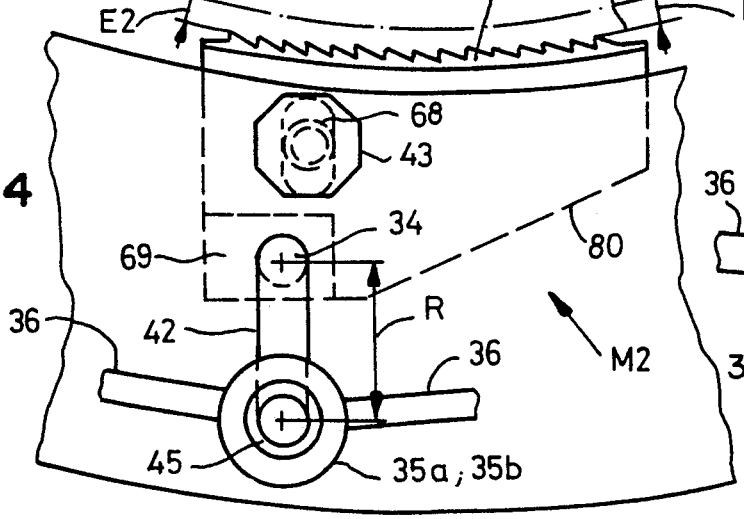
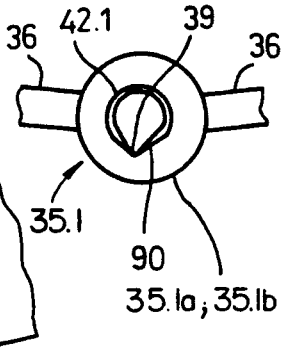

71
70
72
73
W
MI
10
9
14
F
MO
87
33
43
34
T
91
88
35
36
S
92
42.2
35.1
9a
94
93

GRID FOR THE OPENING ROLL OF A SPINNING MACHINE

BACKGROUND OF THE INVENTION

1. Field of the Invention

The present invention relates to a new and improved grid for an opening roll or roller of a spinning machine for processing fibers, for example, a cleaning machine or a card or the like comprising a plurality of grid bars or rods provided in a grid frame and arranged along the circumference of the opening roll or roller. In the environment of a card such opening roll or roller is also referred to as a licker-in or licker-in roll.

The present invention also relates to a fiber cleaning apparatus for a spinning machine for processing fibers equipped with the new and improved grid of the present development.

2. Discussion of the Background and Material Information

Grids for such type textile machines are well known in this technology. For example, Swiss Patent No. 464,021, granted Oct. 15, 1968, and also cleaning machines of the present assignee sold worldwide under the commercial designation Type ERM B5/5 disclose a downwardly pivotable grid to which there are secured a plurality of knifes or cutters for removing contaminants from cotton. The cotton is moved past the knifes by an opening roll provided with teeth, also referred to as clothing. Adjustable guides, for example, sheet metal guides, are provided at the spine or rear side of the knifes, so that by virtue of the adjustability of the guides there can be set the guidance of the cotton lying on the clothing of the opening roll from knife edge to knife edge in such a manner that there is realized a settable elimination of contaminants from knife to knife. These knifes are fixedly secured to the grid which, in turn, can be pivoted away from the opening roll.

Furthermore, United Kingdom Patent Application No. 2,053,995, published Feb. 11, 1981, depicts and describes the possibility of positionally adjusting pivotable knifes by means of a grid or grill such that there can be altered the angle of attack of such pivotable knifes with respect to the circumference of the opening roll. To that end, the knifes are pivotably mounted at stationary pivot shafts at their front end portions where there are located the knife edges, and the rear end portion of each knife is pivotably mounted in the grid or grill. Thus, by moving the grid or grill in the circumferential or peripheral direction of the opening roll there can be altered the angle of attack of the knifes with respect to the circumference of the opening roll, which circumference is also referred to as the beater circle.

Both types of equipment relate to older generation machines which at that time were intended to process less contaminated cotton at a lower production capacity or output.

However, in the last fifteen years the spinning machine industry has strived to increase the production capacity of each individual type of machine with the objective of being able to process more contaminated cotton, especially cotton containing fine contaminants or rejects like, for example, so-called seed coat fragments.

Additionally, persons skilled in spinning technology are well aware of the fact that, on the one hand, the finer the contaminants the more difficult it is to remove such fine contaminants from the cotton fibers which usually are markedly intertwined with one another and, on the other hand, the danger of damaging the fibers increases in direct relationship to an increase in the production capacity of the relevant machine.

Increasing demands are thus placed by the spinning machine industry upon cleaning machines or elements which perform cleaning functions, since a fundamental prerequisite for the cleaning of cotton is the positive disengagement or disentanglement of the previously mentioned intertwined cotton fibers which form cotton flocks, but however, without thereby altering, to the extent possible, the cotton fibers, for example, reducing the length of the cotton fibers.

Impacting or beating cotton flocks against knife edges, as occurs in the aforementioned cleaning machines, indeed produces a cleaning action at those fiber flock surfaces contacting the knife edges, but, on the other hand, opening of the fiber flocks only occurs in a subordinate fashion during such treatment

SUMMARY OF THE INVENTION

Therefore, with the foregoing in mind, it is a primary object of the present invention to provide an improved opening and cleaning apparatus which is not afflicted with the aforementioned shortcomings and drawbacks of the prior art.

Another and more specific object of the present invention aims at providing an improved apparatus which is capable of opening fiber flocks or the like as well as cleaning the same in an intensive yet protective manner.

Still a further noteworthy object of the present invention is the provision of an improved construction of grid for an opening roll of a spinning machine which affords protective and efficient cleaning of fiber materials.

Another important object of the present invention contemplates a fiber cleaning apparatus for a spinning machine for processing fibers and equipped with the new and improved grid of the present development.

Now in order to implement these and still further objects of the present invention, which will become more readily apparent as the description proceeds, the grid or grill for an opening roll for spinning machines as contemplated by the present development is manifested, among other things, by the features that the grid bars or rods comprise separate grid bar modules possessing selectively different processing functions for the fibers, namely different fiber guiding- and/or different opening- and/or different cleaning functions, and such grid bar modules can be mounted in an alterable sequence in the grid frame.

According to the invention, at least one of the grid bar modules can be provided with toothed or point clothing for accomplishing the opening function and the cleaning function for the fibers.

Still further, at least one of the grid bar modules can be provided with a blower nozzle for accomplishing the opening function and cleaning function for the fibers, and such blower nozzle issuing an air jet therefrom which is directed towards the circumference of the opening roll.

Moreover, the grid bar modules can possess as the selectively different processing functions for the fibers at least a guiding function for the fibers. To that end, at least one of the grid bar modules comprises a fiber retention surface for accomplishing the guiding function for the fibers.

The present invention further contemplates that at least one of the grid bar modules comprises a turning element situated opposite a beater circle for accomplishing the processing function for the fibers.

According to one embodiment, this turning element can comprise an apertured turning element. Alternatively, the turning element can comprise a suction element provided with suction means.

Also the present invention provides means for selectively mounting the grid bar modules to be fixed or pivotable in the grid frame.

Furthermore, the present invention envisages that there can be provided a pivot shaft for pivotally mounting an end region of the grid frame for pivotable movement in a predetermined direction of rotation of the opening roll. And, still further, there can be provided means for setting the amount of pivotable movement of the grid frame in the predetermined direction of rotation of the opening roll.

According to a further aspect of the present invention there are provided means for moving the pivot shaft in at least one degree of freedom of movement Moreover, controlled positioning or motor means can be provided for displacing or pivoting the grid frame and controlled positioning or motor means for displacing the grid modules.

By providing means for pivotally mounting the grid frame for pivotable movement away from the circumference of the opening roll there can be readily performed maintenance or servicing work at the spinning machine.

Still further, the invention contemplates a fiber cleaning apparatus for a spinning machine for processing fibers, comprising a grid for an opening roll of the spinning machine. This grid comprises a grid frame and a plurality of grid bars provided in the grid frame and arranged along the circumference of the opening roll, wherein the grid bars comprise separate grid bar modules possessing selectively different processing functions for the fibers and the grid bar modules are mountable in an alterable sequence in the grid frame. Also, controlled motor-operated means serve for displacing the grid frame and the grid modules. Sensor means monitor the brightness and/or the amount of contaminants eliminated from the fibers. The sensor means transmit control signals to control means for controlling operation of the controlled motor-operated means.

Still further, the control means can comprise computer means for processing the control signals received from the sensor means. Such computer means advantageously contain different predetermined programs for adjusting the position of the grid bar modules as a function of the material of the processed fibers.

According to a further embodiment of the present invention, there is contemplated a fiber cleaning apparatus for a spinning machine for processing fibers, which comprises a grid for an opening roll of the spinning machine. This grid comprises a grid frame and a plurality of grid bars provided in the grid frame and arranged along a circumference of the opening roll. The grid bars comprise separate grid bar modules possessing selectively different processing functions for the fibers as previously explained. These grid bar modules are mountable in an alterable sequence in the grid frame. An opening roll cooperates with the grid and such opening roll includes a fiber take-over location. Also provided are fiber infeed means for infeeding fibers. The fiber infeed means including a fiber delivery location, and the fiber infeed means serve for altering the spacing between the fiber delivery location of the fiber infeed means and the take-over location of the opening roll.

Still further, the fiber infeed means can comprise a feed roll and a feed trough cooperating with the feed roll. The fiber delivery location is defined by the feed roll and the feed trough, and the fiber take-over location is defined by the feed roll and the opening roll. There also can be provided means for displacing the feed trough about the feed roll.

Certain of the more notable advantages of the present invention reside in the fact that, on the one hand, due to the modular construction the grid bar modules can be selectively exchanged, and, on the other hand, due to the adjustability of the entire grid or grill in relation to the surface of the opening roll and by virtue of the adjustability of the grid bar modules in the grid there is afforded an optimum accommodation to the cotton to be cleaned in order to release the contaminants from the cotton in a protective fashion while still extensively eliminating such contaminants from the cotton.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures thereof there have been generally used the same reference characters to denote the same or analogous elements or components, and wherein:

FIG. 2 is a fragmentary top plan view of the arrangement of FIG. 1, taken substantially along the section line I—I thereof;

FIG. 3 is an enlarged detail view of a portion of the structure depicted in FIG. 2 at the region enclosed by the circle labelled by reference character V;

FIG. 4 is a fragmentary view of the arrangement of FIG. 3, looking in the direction of the arrow II thereof;

FIG. 13 illustrates a modification of a part or component of FIG. 4;

DETAILED DESCRIPTION OF THE PREFERRED EMBODIMENTS

Describing now the drawings, it is to be understood that only enough of the construction of the relevant textile machine and the related grid structure have been depicted therein, in order to simplify the illustration, as needed for those skilled in the art to readily understand the underlying principles and concepts of the present invention.

Figure 1:
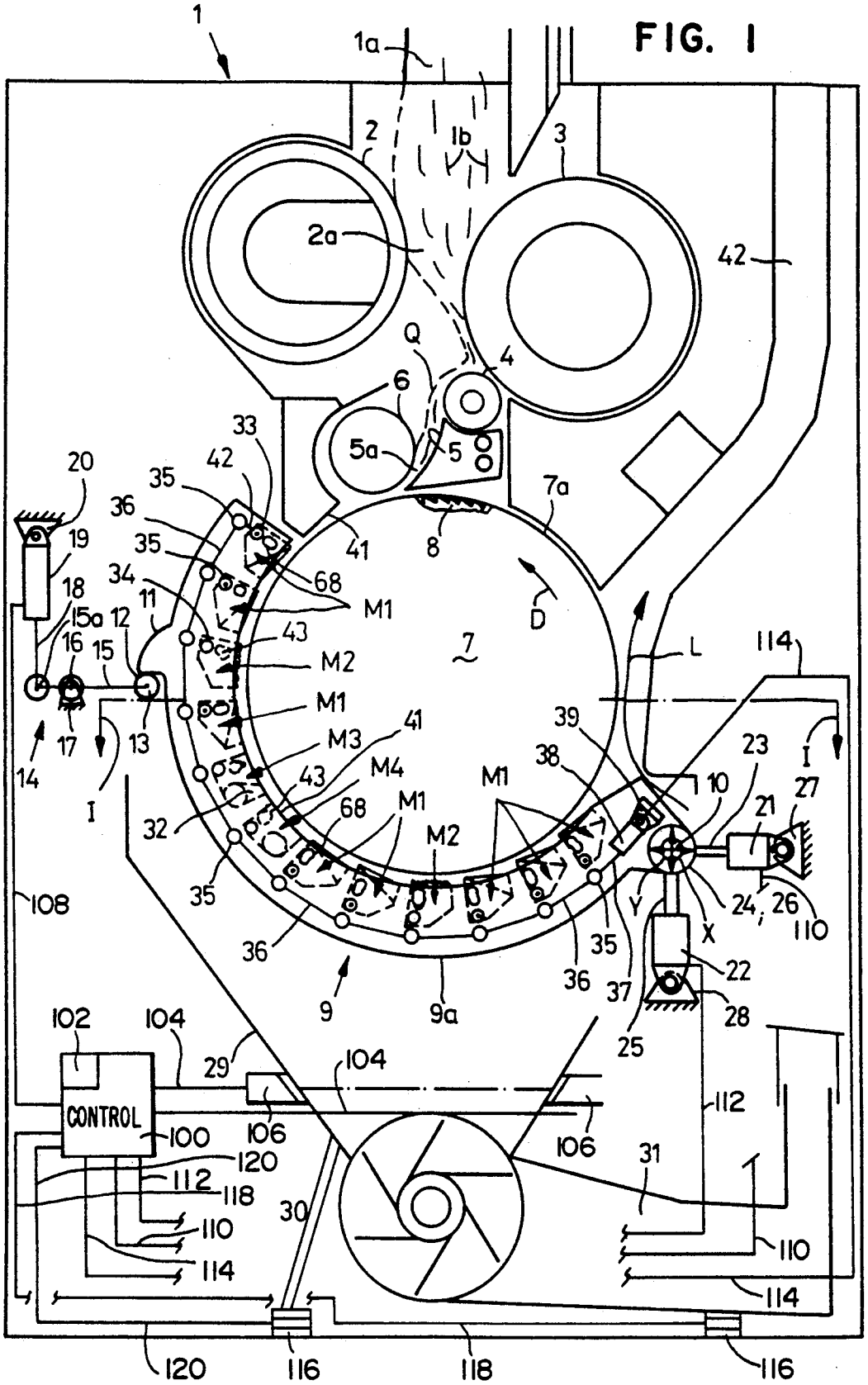
FIG. 1 is a cross-sectional view, semi-schematically, through a cleaning machine equipped with a grid constructed according to the present invention.

Turning attention now to FIG. 1, there is depicted a cleaning machine 1 having a feed chute or duct 1*a* which delivers fiber flocks or flock material, generally indicated by reference character 1*b*, into a converging gap or space 2*a* between a dummy drum 2 and a sieve or perforated drum 3. The sieve or perforated drum 3 suctionally withdraws air from the infed cotton of the fiber flocks or flock material 1*b*. This cotton material, from which there has been removed the air, is deposited in the form of a fiber mat or batt Q at a doffer roll or roller 4 and from that location is guided into a further converging space or gap 5*a* between a feed trough 5 and a feed roll 6. The fiber mat or batt Q or the like is supplied by the feed roll 6 to an opening roll or roller 7.

This opening roll 7 entrains the infed fibers by teeth 8—also referred to as toothed or point clothing—provided at the roll surface 7*a* and there is thus formed in known manner at such roll surface a fiber layer in the form of a fiber web guided by the teeth 8. Due to the relatively great circumferential or peripheral velocity of the opening roll 7 and the resulting centrifugal force, this fiber web tends to be propelled away from the teeth 8. It is for this reason that the fiber web, prior to delivery to a first grid bar module M1, depending upon the spacing between the feed roll 6 and this first grid bar module M1, is guided by a guide surface or guide 41 arranged forwardly or upstream of the first grid bar module M1, as viewed with respect to the direction of rotation D of the opening roll 7, and therefore, such fiber web is prevented from being propelled away from the surface 7*a* of the opening roll 7.

As will be seen in FIG. 1, the fiber web or layer is subsequently moved past a series of cleaning elements or grid bar modules or grid modules, generally indicated by reference characters M1, M2, M3 and M4, arranged in a predetermined sequence.

These separate or individual grid bar modules or grid modules M1, M2, M3 and M4 are depicted on an enlarged scale in FIGS. 3 to 7 and will be hereinafter described with reference thereto.

Figure 5:
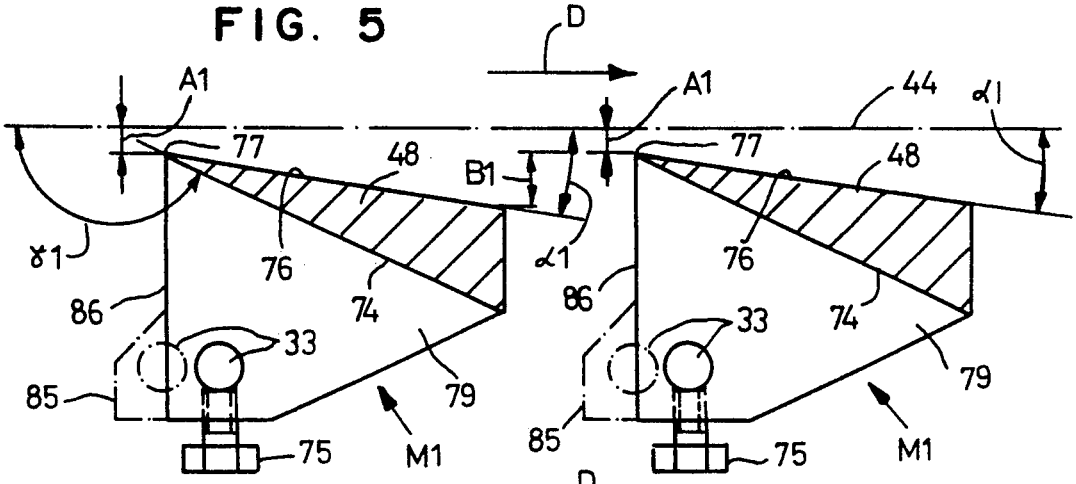
FIG. 5 is a semi-schematic illustration of an element according to the present invention in a dual grouping.
Figure 6:
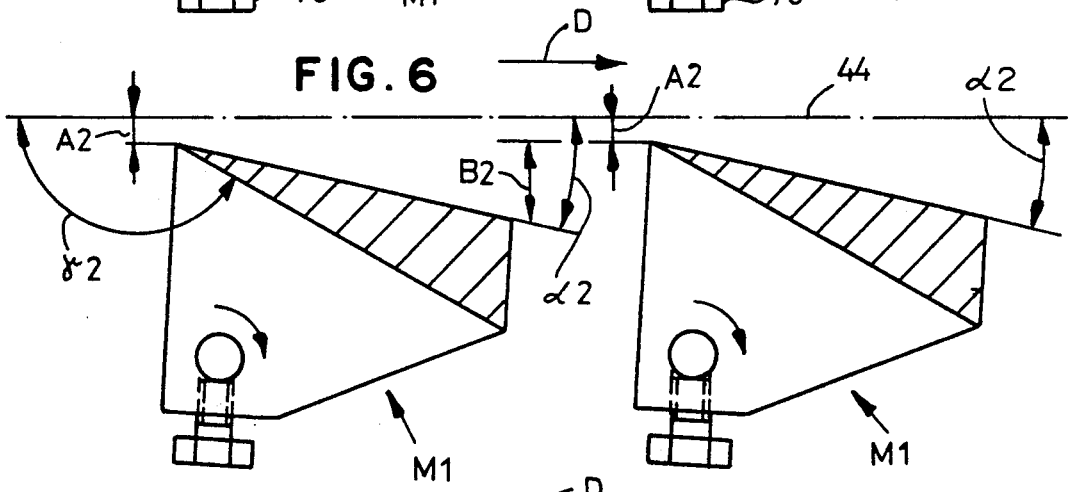
FIG. 6 is a semi-schematic illustration of the dual-grouped element of FIG. 5, but shown in a different position.

As concerns the grid bar modules M1, each such grid bar module M1 comprises a grid bar or rod 48 defining fiber processing means having flanges 79 on its end or front faces and provided with a separating or separation edge 77 and a guide surface 76 (see FIGS. 5 and 6). On the other hand, the grid bar modules M2 each comprise fiber processing means in the form of a clothing bar or rod 80*a* having flanges 80 on its end or front faces and provided with point or toothed clothing 49 (see FIGS. 3 and 4).

By referring for instance to FIG. 7, it will be seen the grid bar module M3 comprises fiber processing means in the form of a blower or blast nozzle 69 having a blast or blower air connection or stud 83 and provided at its end faces with flanges 81, whereas the grid bar module M4 constitutes a so-called turning or deflection element 41 defining fiber processing means which will be more fully considered hereinafter and equipped with flanges 82 at its end faces and a suction connection or stud 47.

In principle, the combination of the grid bar modules M3 and M4 constitutes subject matter of the aforementioned commonly assigned, copending U.S. application Ser. No. 07/585,985, filed Sep. 21, 1990, entitled "Method and Apparatus for the Fine Cleaning of Textile Fibers" and shows and describes therein further embodiments, to which reference may be readily made and the disclosure of which is incorporated in its entirety herein by reference. Therefore, the subject matter of this just mentioned copending U.S. application Ser. No. 07/585,985 constitutes an integral part of the present application as concerns further, here not illustrated variants of this turning function.

The grid bar modules M1, M2, M3 and M4 are mounted in a grid or grill 9 either rigidly or fixed and/or pivotable, as such will be considered in greater detail during the course of this description.

Continuing, it will be understood the grid 9 comprises in the machine cross-direction two spaced grid frames or housings 9*a*, only one of which is visible in FIG. 1. As previously mentioned, between such grid frames or housings 9*a* the grid bar modules M1, M2, M3 and M4 are mounted to be either rigid or fixed and/or pivotable. In this regard, it will be further understood that the flanges or flange members 79, 80, 81 and 82 of the grid bar modules M1, M2, M3 and M4 bear against the inner surface 84 of the grid frames 9*a*, as shown in FIGS. 2 and 3 for the flanges 80.

As will be seen by inspecting FIG. 1, the grid frames 9*a*, and thus, the grid 9, are pivotably mounted by means of a pivot shaft or axle 10 defining a pivot axis and which is pivotably mounted at its opposite ends in a respective bearing ring 24 and bearing ring 26.

In order to render possible movement of this grid or grill 9 in the freedom of movement directions X and Y, as will be considered shortly, on the one hand, the bearing ring 24 is fastened to a plunger or thrust rod 23 of a positioning or setting motor 21 and, on the other hand, the other bearing ring 26 is fastened to a plunger or thrust rod 25 of a positioning or setting motor 22.

The positioning motor 21 is pivotably connected with a stationary support or mount 27 and the other positioning motor 22 is pivotably connected with a stationary support or mount 28.

As best recognized by further inspecting FIG. 1, the positioning or setting motors 21 and 22, and thus, the two degrees of freedom of movement or freedom of movement directions X and Y are essentially arranged at right angles to one another, in order to be able to accomplish the desired movement or shifting of the grid or grill 9 as will be considered hereinafter.

Each grid frame 9*a* further comprises a guide cam 11 having a guide surface 12 against which bears a guide roll or cam follower 13 constituting part of an adjustment or adjusting mechanism 14.

The function of the adjustment or adjusting mechanism 14 will be considered at a later point in this description, although at the moment it is mentioned the guide roll 13 is rotatably secured at a pivotable lever or lever member 15. This pivotable lever 15 is pivotably mounted by a pivot shaft or axle 16 at a stationary pivot bearing or support 17. The pivotable lever 15 is pivotably connected at the end 15*a* thereof located opposite to the guide roll 13 with the plunger or thrust rod of a positioning or setting motor 19. This positioning motor 19 is pivotably secured to a stationary support or mount 20.

The contaminants or dirt or the like eliminated from the cotton is captured in a waste receiver trough 29 and delivered to a drain or gate 30 which feeds such waste material to a pneumatic transport means or system 31. On the other hand, the fiber web which is moved by the opening roll 7 past the grid bar modules or grid modules M1, M2, M3 and M4, after passing the last grid bar module, as viewed with respect to the direction of rotation D of the opening roll 7, is entrained by a pneumatic conveying or transport air current or air flow L. Instead of using the depicted rotary drain or gate 30 there also could be used a flap gate or any other suitable drain or gate.

In FIG. 1 there is depicted by means of the illustrated sequence of the grid bar modules M1, M2, M3 and M4 a modular construction, as contemplated by the present invention, of these grid bar modules, which in the manner depicted in FIG. 1 should be considered to constitute a possible embodiment.

Since one is dealing with modules it should be specifically understood that there clearly exists the possibility of arranging each grid bar module, as desired, at any given one of the locations depicted in FIG. 1.

Optimization of the arrangement and sequence of these grid bar modules or grid modules M1, M2, M3 and M4 is the result of a series of tests which, depending upon the fiber material to be cleaned and the contemplated cleaning intensity, can vary.

In the exemplary embodiment depicted in FIG. 1, after the two grid bar modules M1, each having a grid bar 48, there follows a grid bar module M2 equipped with point or toothed clothing 49 analogous to a clothing bar of, for instance, a card-clothing bar, then there again follows a grid bar module M1 with a grid bar 48, thereafter there follows a grid bar module M3 having a blower or blast nozzle 32, and then there finally follows a grid bar module M4 having a turning or deflection element 41. After such turning or deflection element 41 there are again provided two grid bar modules M1, thereafter a grid bar module M2 and again three grid bar modules M1.

After the last grid bar module M1, the fiber layer or web reposing upon the teeth or points 8 of the opening roll 7, due to the action of the prevailing centrifugal force and a sucked-in air stream or flow L, arrives at such air stream or flow L and thereafter is engaged by a pneumatic suction system 42 and delivered to the next downstream located machine.

In the following description there will be given a more detailed disclosure of the functioning of the movement of the grid bar modules M1 and depending upon the module selection also the further grid bar modules.

In FIG. 1, a circle designated by reference numeral 33 and containing therein a block dot, is intended to represent a fixed connection of a pivotable lever 42 (only depicted once in FIG. 1 to simplify the showing) with an associated grid bar module, such as the grid bar module M1 and at the same time also represents the pivot shaft or axis of the pivotable lever 42 and the related grid bar module, so that upon pivoting this pivotable lever 42 the grid bar module, such as the grid bar module M1 is pivoted about this pivot shaft or axis 33. The arresting or fixation of the position of the grid bar module M1 upon the pivot shaft 33 is accomplished by an arresting or fixing screw 75 or equivalent structure, as best seen in FIGS. 5 and 6.

The other end of each pivotable lever 42 is pivotably connected by a respective pivot or hinge joint or location 35 with an associated force transmission lever 36. The last one of the pivot or hinge joints or locations 35, as viewed in the direction of rotation D of the opening roll 7, pivotably connects the preceding force transmission lever 36 with a plunger or thrust rod 37 of a positioning or setting motor 38 which, in turn, is pivotably connected with a stationary support element or mount 39. Since all of the force transmission levers 36 are interconnected with one another by the pivot or hinge joints or locations 35, all of these force transmission levers 36 simultaneously participate in the movement of the plunger 37, so that there are pivoted or rocked all of the grid bar modules which have a fixed connection with the related pivotable lever 42.

Furthermore, it will be observed that in FIG. 1 there are also illustrated circles 34 which do not contain a dot therein, and these empty circles 34 signify that at these locations the grid bar modules or grid modules, for example the grid bar modules M2, M3 and M4 are not connected with a related pivot shaft 33, and thus, also not with a related pivotable lever 42, and that the pivot shafts 33 and the pivot levers 42 are only required so that the force or power transmission can be accomplished through all of the force transmission levers 36.

The fixedly arranged grid bar modules M2, M3 and M4 are fixedly connected with the grid frames **9*a* by means of an associated fixation screw or threaded bolt 43 or the like which is threadably secured in an associated flange or flange member 80, 81 or 82 (see, for instance, FIG. 4). The screw or threaded bolt 43 is guided in an associated guide slot or opening 68 provided in the grid frames 9*a* and which extend radially with respect to the axis of rotation of the opening roll 7, so that the position of the corresponding grid bar module can be changed within this guide slot 68**.

In the exemplary embodiment of FIG. 1 only the grid bar modules M1 are pivotably mounted, that is, those provided with a grid bar 48, whereas the modules M2 and M3 and also the modules M4 are fixed in place, that is, fixedly arranged.

As previously explained, the possibility exists, however, to adjustably fix the modules M2, M3 and M4 in different positions, for instance, to positionally adjust, for instance, the module M3 in order to allow the air jet of the blower or blast nozzle 32 to impinge at a different angle $\beta$ (FIG. 7) upon the teeth or points 8 of the opening roll 7, and this angle $\beta$ also can be greater than 90°; or else to positionally adjust the module M2 such that the toothed or point clothing 49 is positionally disposed such that the spacings E1 and E2 between the tooth tips of the toothed clothing 49 and the beater circle 44 containing the teeth tips of the opening roll 7 (FIG. 4) are not the same at all locations; or to arrange the grid bar module M4 (FIG. 7) such that the distances G1 and G2 at the edges of a turning or deflection surface 46 with respect to the beater circle 44 are unequal. For this purpose the grid frames **9*a* possess sufficiently long guide slots 68. On the other hand, the grid bar modules M2, M3 and M4 also can be pivotably arranged like the grid bar module M1**.

Furthermore, there exists the possibility of altering the radial length R (FIG. 4) of the pivotable lever 42 by replacing this pivotable lever 42 for one having a different radial length, so that, for example, with the same pivotal path there are possible greater positional changes of the related grid bar module with a smaller length R.

In other words, neither the illustrated arrangement of the grid bar modules or grid modules nor the sub-division into fixed and pivotable elements nor the depicted uniform adjustment possibility constitute a limitation, rather there exists the possibility of exchanging the modules and force transmission levers 36 and pivotable levers 42 as well as replacing the rigid or fixed connection with a pivotable connection.

Figure 7:
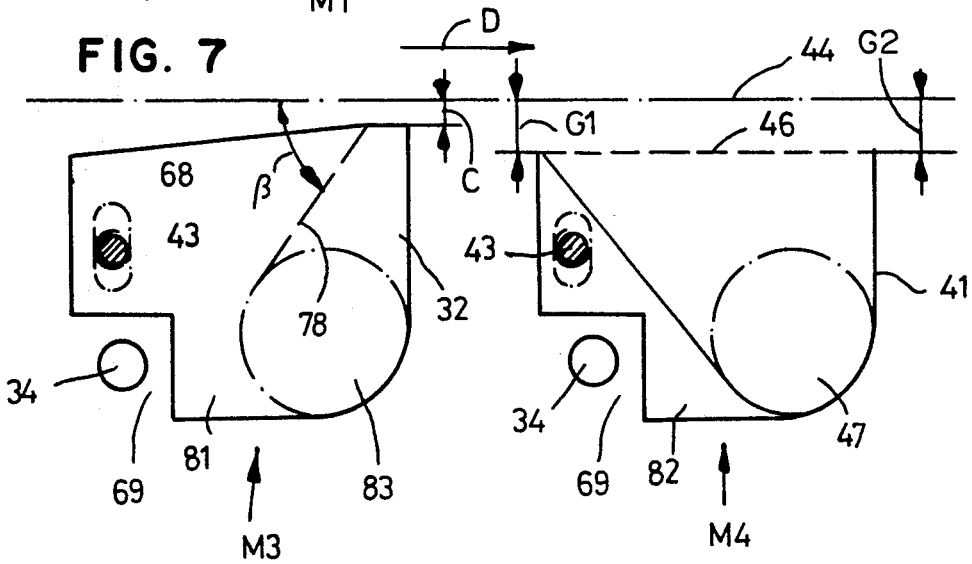
FIG. 7 is a semi-schematic illustration of two different elements in an arrangement according to the present invention.

In FIGS. 5, 6 and 7 the beater circle 44 as well as the guide surface 76 of the grid bars 48 has been conveniently schematically illustrated as being straight or linear. Therefore, it should be understood that the guide surface 76, analogous to the depicted curvature or arching Z (FIG. 4) of an imaginary surface containing the tooth tips or points of the clothing 49, is curved in a similar manner corresponding to requirements.

By means of the positioning or setting motors 21 and 22 as well as with the adjustment or adjusting mechanism 14 there is afforded the possibility of changing the position of the grid and thus the distances or spacings A1 respectively A2 (FIGS. 5 and 6), C and G1 respectively G2 (FIG. 7) as well as E1 and E2 (FIG. 4), whereas there can be altered the distance or spacing B—meaning the distance between the rear end or edge of the guide surface 76 of one grid bar 48 and the guide edge 72 of the neighboring grid bar 48 as indicated at B1 and B2 in FIGS. 5 and 6, respectively—as well as the clearance angle $\alpha$ and the angle of attack $\gamma$ with the aid of the pivotability and the angle $\beta$ (FIG. 7) with the aid of the adjustability of the grid bar modules. In particular, by means of the adjustment mechanism 14 there is afforded the possibility of rocking the grid 9 about the pivot axis of the pivot shaft or axle 10 and independently thereof by means of the positioning motors 21 and 22 to shift the pivot shaft or axle 10 in an XY-plane. In the simplest case the pivot shaft 10 is stationary.

Figure 8:
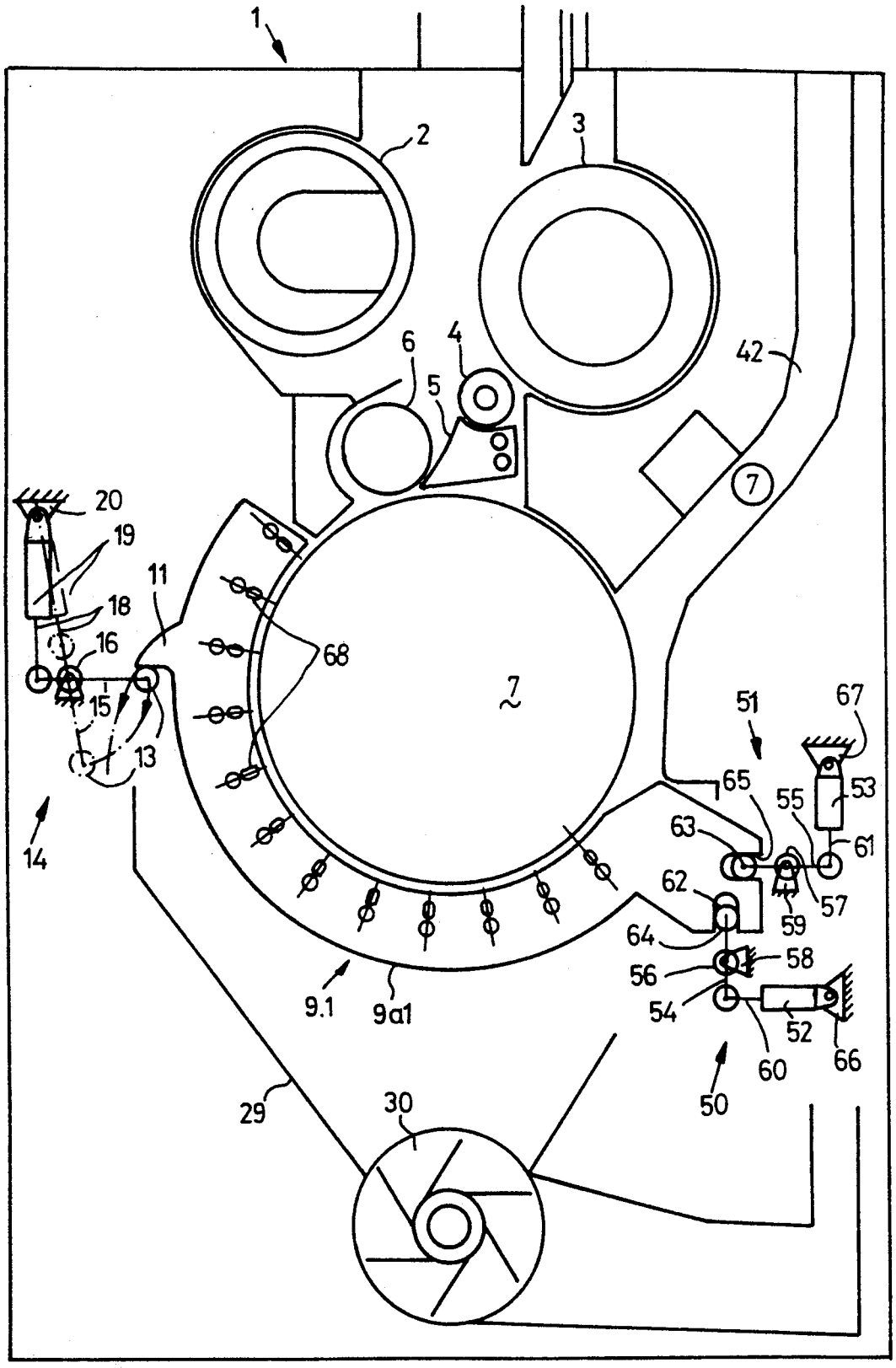
FIG. 8 is a modified embodiment of part of the cleaning machine depicted in FIG. 1.

The positioning or setting motors can be suitable commercially available positioning motors, for example, spindle motors. Additionally, a particular aspect of the positioning motor 19 and respectively the entire adjustment mechanism 14 is that, on the one hand, the adjustment mechanism 14 must accomplish very small movements in the order of tenths of a millimeter in order to alter the aforementioned distances, but, on the other hand, must accomplish a large movement, shown in FIG. 8, in order to enable downward pivoting—considered with regard to FIG. 8—of the grid 9. In FIG. 8 the grid is identified by reference numeral 9.1.

FIG. 2 depicts part of a top plan view of the arrangement of FIG. 1, taken substantially along the section line I—I thereof, and therefore there have been conveniently used the same reference characters for the same parts or components.

In FIG. 3 there is shown with greater clarity the attachment of a grid bar module, for example, the grid bar module M2 by means of the screw or threaded bolt 43. Equally, there have been more clearly depicted the pivot or hinge joints 35 in that there has been illustrated that for each pivot or hinge joint 35 there is connected a respective ring 35*a* or 35*b* with a force transmission lever 36 and, on the other hand, these rings 35*a* and 35*b* are pivotally mounted upon pivotable lever 42. The axial displacement of these rings 35*a* and 35*b* upon the pivotable lever 42 is prevented by arresting or locking rings 45.

FIG. 4 shows in front view part of the arrangement of FIG. 3, viewed in the direction of the arrow II, and there have again been used the same reference characters for the same parts or components. FIG. 4 depicts, apart from the guide slots 68 provided in the grid frames 9*a* which also have been shown in FIGS. 1 and 8, also a recess or cutout 69 or the like depicted in broken lines, a respective one of which is provided in all of the flanges 80, 81 and 82 of the grid bar modules M2, M3 and M4 in order to enable movement of such modules in the aforementioned frame about the pivot shaft or axle 34 defining a pivot axis.

FIGS. 5 and 6 each show two grid bar modules M1 on an enlarged scale. The grid bar modules M1 of FIG. 6 possess an angle of attack $\gamma 2$ which is smaller than the angle of attack $\gamma 1$ and a clearance angle $\alpha 2$ which is larger than the clearance angle $\alpha 1$ of the grid bar module of FIG. 5. The angle of attack $\gamma$ is formed by a guide surface 74 and the beater circle 44 shown in FIGS. 5 and 6 as a straight line, and the clearance angle $\alpha$ is formed by the beater circle 44 and the guide surface 76 shown in simplified representation in FIGS. 5 and 6 as a straight line. The guide surface 74 serves to guide the contaminants or dirt which has been released from the fiber web.

In such FIGS. 5 and 6 there will be further seen that due to the position of the pivotable shaft 33 at the region of the depicted left-hand situated corner of the grid bar module, considered with regard to the direction of viewing of these figures, in other words, essentially at the same side of the grid bar module which contains the separation or knife edge 77, that as a result, upon pivoting of the grid bar module about the rotational axis of the pivot or pivotable shaft 33, on the one hand, there is increased the clearance angle $\alpha$ from $\alpha 1$ to $\alpha 2$ and the distance or spacing B increases from B1 to B2 and, on the other hand, the distance or spacing A2 is not appreciably greater than the distance or spacing A1, that is, has practically not changed, so that the spacing A1 which has been set by adjusting the grid 9 by means of the aforementioned pivoting, is only inconsequentially slightly changed. Ideally, the flange 79 possesses a projection or protuberance 85, shown in broken lines, so that there exists the possibility of placing the pivotable shaft 33 centrally of the side edge or line 86, so that the clearance angle $\alpha$ then assumes the smallest value when the side edge or line 86 extends radially with respect to the beater circle 44.

FIG. 7 depicts the grid bar modules M3 and M4 on an enlarged scale. The grid bar module M3 contains the previously considered blower nozzle 32 and a blower air connection or stud and extends over the entire length of the opening roll 7. A guide surface 78 of this blower nozzle 32 encloses together with the beater circle an angle $\beta$ which also can exceed 90°. There also will be seen the slot 68 and the recess or cutout 69.

The grid bar module M4 contains the aforementioned turning or deflection element 41 provided with the apertured, so-called turning or deflection surface 46 and with the suction connection or stud 47. This suction connection 47 sucks air through the apertured or perforated turning or deflection surface 46 and thus, just as is the case in the aforementioned commonly assigned, copending U.S. application Ser. No. 07/585,985, filed Sep. 21, 1990, brings about a turning or deflection of the fiber layer such that this turned or deflected fiber layer is then delivered to the next following cleaning grid bar modules. Furthermore, the grid bar module M4 likewise possesses the aforementioned slot 68 and the recess or cutout 69.

FIG. 8 depicts a variant of the pivotable suspension of the grid frame 9*a*.1 in contrast to the suspension of the grid frame 9*a* in that, here, instead of providing the pivot shaft or axle 10 shown in FIG. 1, the grid frame 9*a*.1, as viewed with regard to the illustration of FIG. 8, is stabilized in the Y-direction by a guide roll or roller 63 and in the X-direction, again considered in relation to FIG. 8, by a guide roll or roller 62, that is to say, is held fixed in the corresponding directions. To this end, each guide roll 62 is guided in an associated slot 64 of the frame 9*a*.1 and each guide 63 in an associated slot 65 of the same frame 9*a*.1.

The guide roll 62 is part of an adjustment or setting mechanism 50 and the other guide roll 63 is part of an adjustment or setting mechanism 51.

The adjustment mechanism 50 further comprises a positioning or setting motor 52 equipped with a plunger or thrust rod 60 which is pivotally connected with a pivotable lever 54. This pivotable lever 54 is connected with the guide roll 62 and by means of a pivotable shaft 56 is pivotally mounted at a stationary support or carrier element 58. The positioning motor 52 is pivotally connected with a stationary support or carrier element 66.

The adjustment mechanism 51 comprises a positioning or setting motor 53 equipped with a plunger or thrust rod 61 which is pivotally connected with a pivotable lever 55, at the opposite end of which there is provided the guide roll 63. This pivotable lever 55 is pivotally mounted by means of a pivotable shaft 57 upon a stationary support or carrier element 59 and the positioning motor 53 is pivotally connected with a stationary support or carrier element 67.

By virtue of the movements of the adjustment mechanisms 50 and 51 and the adjustment mechanism 14, the grid 9.1 can be displaced in the X-direction and the Y-direction, as viewed with respect to FIG. 1, so that the aforementioned distances can be altered.

Figures 9, 10, 11, 12, 14:
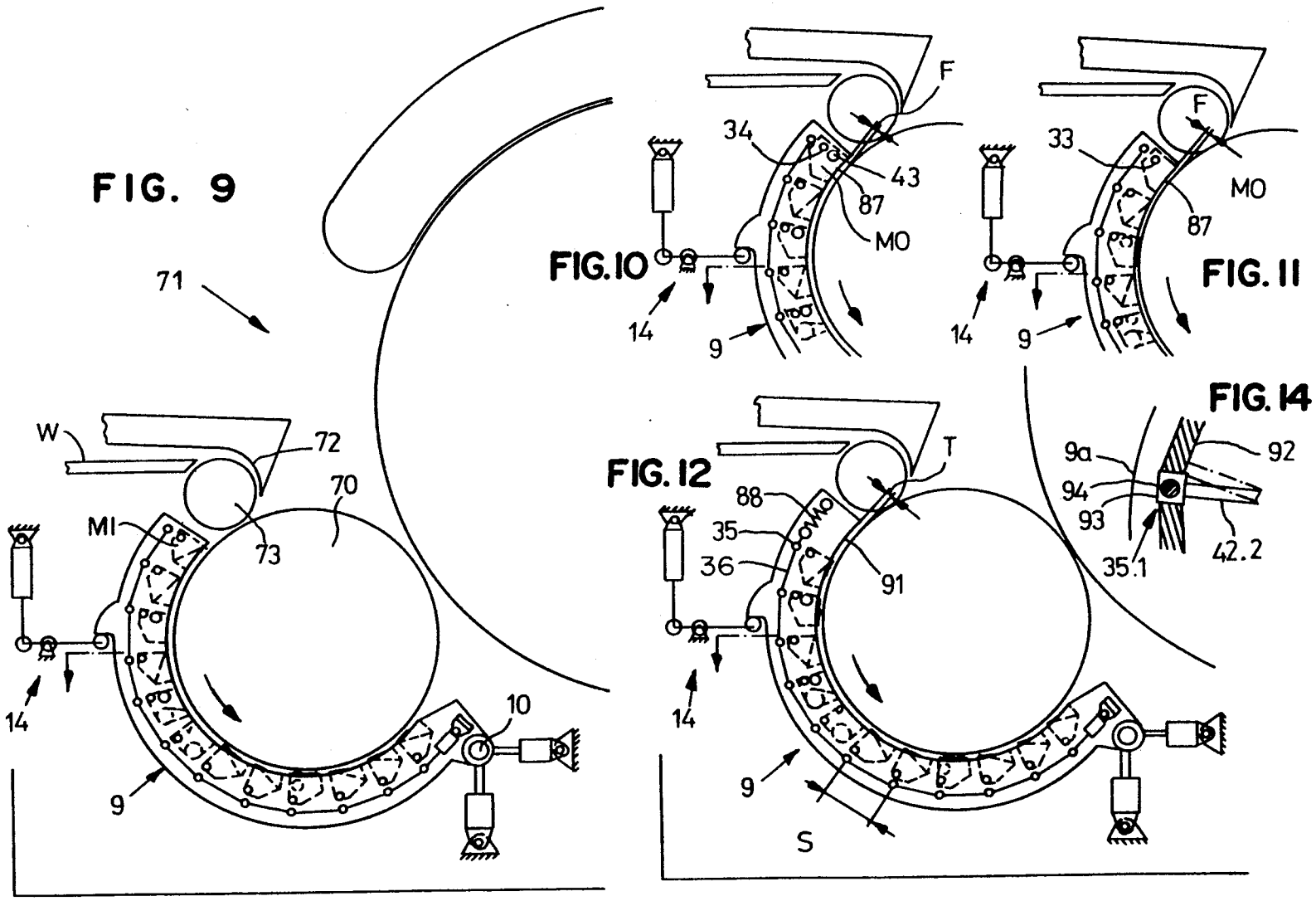
FIG. 9 depicts the grid or grill of the present invention arranged at the licker-in or licker-in roll of a card or carding engine.
FIGS. 10, 11 and 12 are respective modified embodiments of part of the arrangement of FIG. 9.
FIG. 14 illustrates a modification of a detail of FIG. 12.

FIG. 9 illustrates the inventive use of the grid 9 in conjunction with a licker-in roll 70 of a card 71. The same reference characters denote the same elements as previously considered. The infeed of a fiber wadding or batt W or the like occurs by means of a feed trough 72 and a feed roll 73.

FIG. 10 illustrates the possibility of employing grid bar module or grid module M0 instead of the grid bar module M1 as such has been depicted in FIG. 9. Owing to the mobility of the grid bar module M0 the latter possesses a movable retention or holdback surface 87. As shown in FIG. 10, this grid bar module or retention module M0 can be fixedly arranged by means of the screw or threaded bolt 43 or equivalent fastening means, or, as depicted in FIG. 11, can be movably arranged analogous to the grid bar module M1.

FIG. 12 depicts, instead of the grid bar module M0, a tension spring 88 which is connected with a pivot or hinge joint or location 35, so that there is present a continuous tension in the force transmission levers 36. There is thus realized the advantage that the movement produced by the positioning motor 38 is practically free of play.

Through the omission of a grid bar module in favor of a tension spring 88 the grid 9 possesses, at this location, a retention element (not shown) having a retention or holdback surface 91, which is stationary relative to the grid 9 and interconnects both of the grid frames 9*a*.

The retention or holdback surfaces 87 and 91 serve to guide the fibers in the point or toothed clothing of the opening roll 7 and the licker-in roll 70, respectively.

FIG. 13 illustrates by means of the pivot or hinge joint or location 35.1 a variant of the pivot or hinge joint or location 35 of the prior considered figures in that, here, such pivot or hinge joint or location 35.1 possesses a so-called knife edge socket seat or bearing in that the pivotable lever 42.1, a knife or blade 89 and the corresponding pivot joints or locations 35.1*a* and 35.1*b* each possess a seat or socket 90.

This embodiment can be then implemented when, as depicted in FIG. 12, there is used a tension spring 88 in conjunction with the positioning motor 38, since there always prevails a tensional force or tension in the force transmission levers 36. This tension presses the seat or socket 90 against the associated knife or blade 89, and since such a seat or bearing arrangement is practically free of play also the force transmission by means of the force transmission levers 36 is free of play.

Furthermore, when using a tension spring 88, as such is shown in FIG. 12, there is afforded the possibility of using, instead of the force transmission levers 36, a tension cable 92, as depicted in FIG. 14, which is arranged in an eyelet or eye 93 which is part of a pivotable lever or lever member 42.2. The tension cable 92 is fixed in the eyelet or eye 93 by means of a fastening screw or bolt 94 or the like. As a result, there exists the possibility of providing the grid bar modules with different basic settings, as such has been indicated by the chain-dot lines of FIG. 14. In other words, the spacing between the pivot or hinge locations S (FIG. 12) need not always be the same, which, incidentally, is also possible when there are used force transmission levers 36 in that there can be differently determined the lengths of the individual force transmission levers 36. The last-discussed possibility is present when using the force transmission levers 36 also without any tension spring 88.

The utilization of the inventive grids 9 and 9.1 is in no way strictly limited to any of the depicted elements which do not stand in direct correlation with the grid function.

Figure 15:
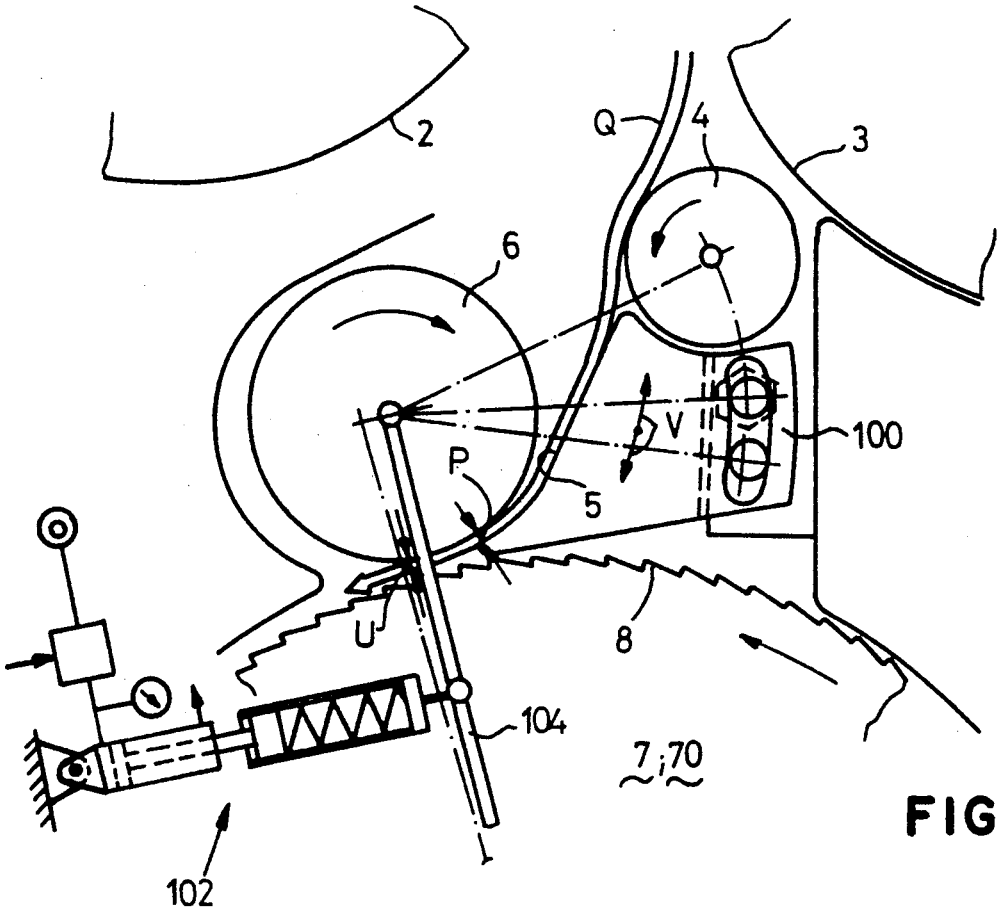
FIG. 15 illustrates FIG. 3 of the commonly assigned, copending U.S. application Ser. No. 07/585,985, filed Sep. 21, 1990, and entitled "Method and Apparatus for the Fine Cleaning of Textile Fibers" for purposes of further explaining the present invention.
Figure 16:
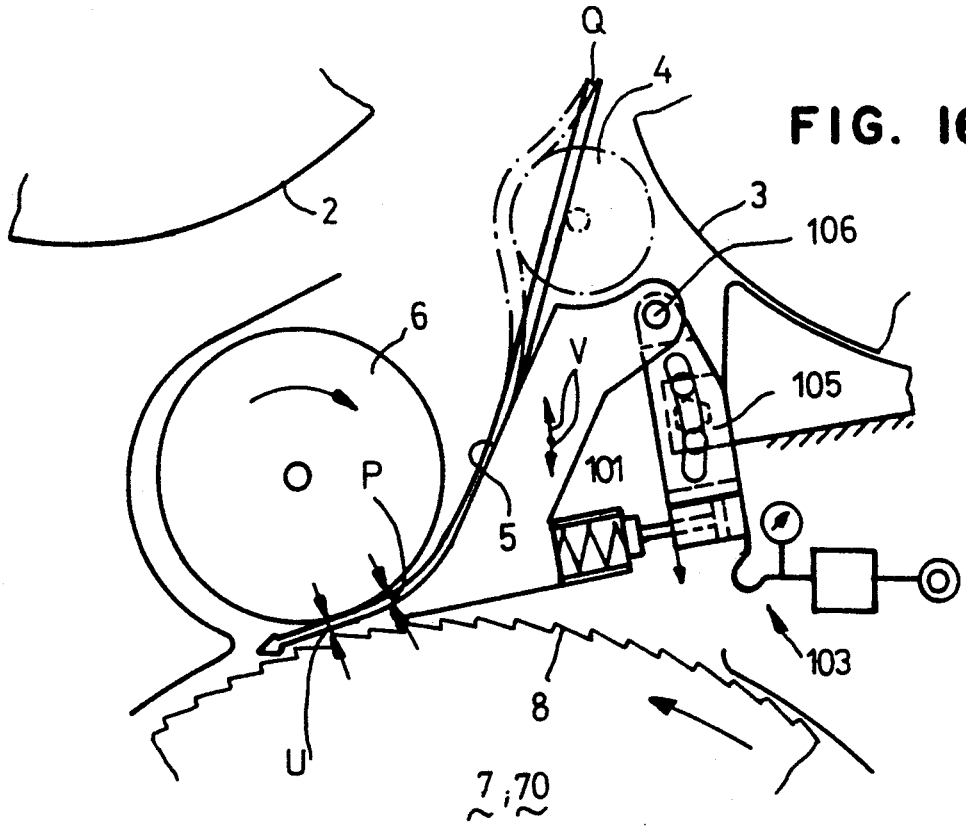
FIG. 16 illustrates FIG. 4 of the aforementioned commonly assigned, copending U.S. application Ser. No. 07/585,985, filed Sep. 21, 1990.

Turning now to FIGS. 15 and 16 such are repeat illustrations of FIGS. 3 and 4, without, however, using the same reference characters, of the aforementioned commonly assigned, copending U.S. application Ser. No. 07/585,985, filed Sep. 21, 1990, entitled "Method and Apparatus for the Fine Cleaning of Textile Fibers". Instead, in such FIGS. 15 and 16 and as a matter of simplification there have been employed reference characters to the extent important for the following description, in order to reiterate aspects which are significant for the present disclosure.

FIG. 15 illustrates a feed trough plate or feed plate 100 provided with a feed trough 5 and which is displaceable in the displacement direction V. There is furthermore depicted a nip or clamping gap P which is formed at the narrowest location between the feed roll or roller 6 and the feed trough 5. This nip P also constitutes a fiber transfer location for the fiber wadding or batt Q or the like. The fiber take-over location U is situated at the narrowest location between the feed roll 6 and the tooth tips or points of the teeth or clothing 8.

By virtue of the mobility or displacement capability of the feed plate 100 in the displacement directions V there exists the possibility of altering the spacing or distance between the nip P and the fiber take-over location U, and thus, to accommodate the arrangement to the fiber length to be processed.

The pressure prevailing in the nip P is produced by means of the pressure-exerting or pressing device 102 in that the feed roll 6 is rotatably and drivingly mounted upon a pivotable or rockable lever 104 which is pivoted by the pressure-exerting or pressing device 102.

FIG. 16 depicts a variant of the pivotability of the feed trough plate, in that here the feed trough plate 101 is displaceable by means of a displacement element 105 about the rotational axis of the feed roll 6, in other words, is displaceable in the displacement direction V, and additionally, is pivotally mounted at a pivot shaft or axle 106 at the displacement element 105, so that the pressure in the nip P can be generated by means of a pressure-exerting or pressing device 103. In all other respects FIG. 16 designates the same elements as shown in FIG. 15 with the same reference characters.

At this point and with reference again to FIG. 1, it will be recognized that the therein depicted and heretofore described fiber cleaning apparatus or cleaning machine 1 for a spinning machine for processing fibers, can be provided with a control or control means 100 equipped with a computer or microprocessor 102 for controlling operation of the positioning motors 19, 21, 22 and 38 defining controlled positioning or motor means for selectively displacing the grid frame 9 and those grid modules, like the modules M1, which, as previously explained are mounted for displacement or pivotable movement.

The control means 100 is connected by lines 104 with suitable brightness sensors 106 arranged at the waste receiver trough or vat 29 through which pass the contaminants or dirt eliminated from the cleaned cotton. These brightness sensors 106 sense the brightness of the eliminated contaminants and deliver resultant brightness detection or control signals via the lines to the control means 100 which are then appropriately processed by the computer or microprocessor 102 for inputting appropriate control signals via the control lines 108, 110, 112 and 114 to the positioning motors 19, 21, 22 and 38, respectively, for carrying out a corresponding positional displacement of the grid frame 9 and the relevant displaceable or pivotable modules, like, for instance, the modules M1. The computer or microprocessor 102 advantageously can contain different predetermined programs for adjusting the position of the grid frame and, in particular, the grid bar modules as a function of predetermined parameters, especially as a function of the material of the processed fibers.

Instead of, or even in addition to the brightness sensors 106, there can be provided sensors 116, such as pressure cells, which cooperate with the waste receiver trough or vat 29. These sensors 116 can determine the weight and thus the quantity of the eliminated contaminants and transmit appropriate detection or control signals via the lines 118 and 120 to the control means 100 where such signals are processed by the computer or microprocessor 102 in order to likewise input appropriate control signals via the control lines 108, 110, 112 and 114 to the positioning motors 19, 21, 22 and 38, respectively, for carrying out a corresponding positional displacement of the grid frame 9 and the relevant displaceable or pivotable modules, like, for instance, the modules M1.

While there are shown and described present preferred embodiments of the invention, it is distinctly to be understood the invention is not limited thereto, but may be otherwise variously embodied and practiced within the scope of the following claims.

What is claimed is:

1. A grid arrangement provided for an opening roller of a fiber processing machine for processing fibers, comprising:

a grid frame;

a plurality of individual grid bars in the grid frame each arranged in spaced relationship along a circumference of the opening roller;

the grid bars comprise separate or individual grid bar modules, at least two modules being of a different form and having different fiber processing functions; and said grid bar modules being arranged and mounted in a predetermined sequence in the grid frame depending upon the condition of the fiber material to be processed and the intended processing intensity.

2. The grid arrangement according to claim 1, wherein the fiber processing machine is a cleaning machine.

3. The grid arrangement according to claim 1, wherein:

the fiber processing machine is a card; and the opening roller defines a licker-in roller of the card.

4. The grid arrangement according to claim 1, wherein:

the grid bar modules a fiber cleaning function.

5. The grid arrangement according to claim 4, wherein:

at least one of the grid bar modules comprises a grid bar containing a separation or knife edge for cleaning the fibers.

6. The grid arrangement according to claim 1, wherein:

at least one of the grid bar modules having at least a fiber opening function.

7. The grid arrangement according to claim 6, wherein:

at least one of the grid bar modules is provided with toothed clothing for accomplishing the opening function for the fibers and a cleaning function for the fibers.

8. The grid arrangement according to claim 6, wherein:

at least one of the grid bar modules is provided with a blower nozzle for accomplishing the opening function for the fibers and a cleaning function for the fibers; and said blower nozzle issuing an air jet therefrom which is directed towards the circumference of the opening roll.

9. The grid arrangement according to claim 1, wherein:

at least one of the grid bar modules having at least a fiber guiding function.

10. The grid arrangement according to claim 9, wherein:

at least one of the grid bar modules comprises a fiber retention surface for accomplishing the guiding function for the fibers.

11. The grid arrangement according to claim 1, wherein:

at least one of the grid bar modules comprises a turning element with a turning or deflection surface opposite a beater circle of the opening roller for accomplishing the fiber processing function.

12. The grid arrangement according to claim 11, wherein:
the turning element comprises an apertured turning element.

13. The grid arrangement according to claim 11, wherein:
the turning element comprises a suction element provided with suction means.

14. The grid arrangement according to claim 1, further including:
means for selectively mounting the grid bar modules to be fixed or pivotable in the grid frame.

15. The grid arrangement according to claim 1, further including:
means for fixedly mounting at least predetermined ones of the grid bar modules in the grid frame.

16. The grid arrangement according to claim 1, further including:
means for pivotally mounting at least predetermined ones of the grid bar modules in the grid frame.

17. The grid arrangement according to claim 1, wherein:
the grid frame has an end region;
the opening roll has a predetermined direction of rotation; and
a pivot shaft for pivotally mounting the end region of the grid frame for pivotable movement in the predetermined direction of rotation of the opening roll.

18. The grid arrangement according to claim 17, further including:
means for setting the amount of pivotable movement of the grid frame in the predetermined direction of rotation of the opening roll.

19. The grid arrangement according to claim 17, wherein:
the pivot shaft has at least one degree of freedom of movement; and
means for moving the pivot shaft in said at least one degree of freedom of movement.

20. The grid arrangement according to claim 17, further including:
controlled positioning means for displacing the grid frame.

21. The grid arrangement according to claim 20, wherein:
the controlled positioning means displaces the grid frame by accomplishing a pivotal movement thereof.

22. The grid arrangement according to claim 1, further including:
controlled positioning means for displacing the grid modules.

23. The grid arrangement according to claim 1, further including:
means for pivotally mounting the grid frame for pivotable movement away from the circumference of the opening roll in order to perform maintenance work at the spinning machine.

24. A grid arrangement for an opening roller of a fiber processing machine, comprising:
a grid frame;
a plurality of fiber processing means provided in the grid frame each arranged in spaced relationship along a circumference of the opening roller;
the fiber processing means comprising separate or individual grid modules having selectively different fiber processing functions; and
means for alternately mounting said grid modules in a predetermined sequence depending upon the condition of the fiber material to be processed and the intended processing intensity.

25. The grid arrangement according to claim 24, wherein:
said mounting means includes structure for movably mounting predetermined ones of said grid modules.

26. The grid arrangement according to claim 24, wherein:
said mounting means includes structure for fixedly mounting predetermined ones of said grid modules.

27. A fiber cleaning apparatus for a fiber processing machine, comprising:
a grid frame for an opening roller of the fiber processing machine;
a plurality of fiber processing means provided in the grid frame each arranged in spaced relationship along a circumference of the opening roller;
the fiber processing means comprising separate or individual grid bar modules having selectively different fiber processing functions; and
means for alternately mounting said grid bar modules in an predetermined sequence in the grid frame depending upon the condition of the fiber material to be processed and the intended processing intensity; and
controlled positioning means for displacing at least one of the grid bar modules;
sensor means for monitoring contaminants eliminated from the fiber material;
control means; and
said sensor means transmitting sensing signals to said control means for controlling operation of the positioning means.

28. The fiber cleaning apparatus according to claim 27, wherein:
the control means comprise computer means for processing the control signals received from the sensor means.

29. The fiber cleaning apparatus according to claim 28, wherein:
the computer means contains a predetermined program for adjusting the position of the grid modules as a function of the material of the processed fibers.

30. The fiber cleaning apparatus according to claim 27, wherein:
the sensor means monitor brightness of the contaminants eliminated from the fibers.

31. The fiber cleaning apparatus according to claim 27, wherein:
the sensor means monitor the quantity of the contaminants eliminated from the fibers.

* * * * *